United States Patent [19]

Bergsand et al.

[11] 4,422,210

[45] Dec. 27, 1983

[54] INSTALLATION FOR INTERNAL CLEANING OF TUBES

[75] Inventors: Arne Bergsand, Floda; Henryk Marsland, Västra Frölunda, both of Sweden

[73] Assignee: Göteborgs Maskinkonsult Aktiebolag, Gothenburg, Sweden

[21] Appl. No.: 320,719

[22] Filed: Nov. 12, 1981

[30] Foreign Application Priority Data

Nov. 12, 1980 [SE] Sweden ..... 8007923

[51] Int. Cl.[3] ..... A47L 5/38

[52] U.S. Cl. ..... 15/302; 15/304; 15/306 B; 134/168 C

[58] Field of Search ..... 15/302, 304, 306 B; 134/152, 166 C, 167 C, 168 C, 169 C, 171, 95, 61

[56] References Cited

U.S. PATENT DOCUMENTS

| | | | |
|---|---|---|---|
| 1,984,771 | 12/1934 | Speller | 134/166 X |
| 2,683,436 | 7/1954 | Marantz | 15/304 X |
| 2,968,584 | 1/1961 | Dickey | 15/306 R X |
| 3,765,050 | 10/1973 | Van Allman et al. | 15/304 |

*Primary Examiner*—Chris K. Moore

*Attorney, Agent, or Firm*—Murray and Whisenhunt

[57] ABSTRACT

With the object of reducing handling time in connection with the internal cleaning of recently drawn metal tubes and with the further object to reduce consumption of cleaning agents and obtaining a well cleaned internal surface a number of tubes (14) is gathered immediately after the drawing installation and they are connected to connecting means (16, 17) for cleaning fluids. The installation comprises a container (22) for chlorinated hydrocarbon and a container (31) for alkali solution with complex formers as additives, a steam generator (28) and preferably also a container (37) for de-ionized water.

A control device (21) is programmed to arrange that the tubes are first flushed with chlorinated hydrocarbon, whereafter the tubes are blown clean with steam. The tubes are flushed with alkali solution after the blowing operation. The tubes are finally submitted to flushing with deionized water and drying with compressed air.

One of the connecting means (17) is mounted on a frame, which can be moved in the length direction of the tubes in order to admit adoption to different nominal tube lengths. Taking into consideration that the tubes will have rather wide length tolerances, the connecting means are provided with connecting means (50), which are individually adjustable in the length direction of the tubes.

9 Claims, 5 Drawing Figures

INSTALLATION FOR INTERNAL CLEANING OF TUBES

Figure 1:
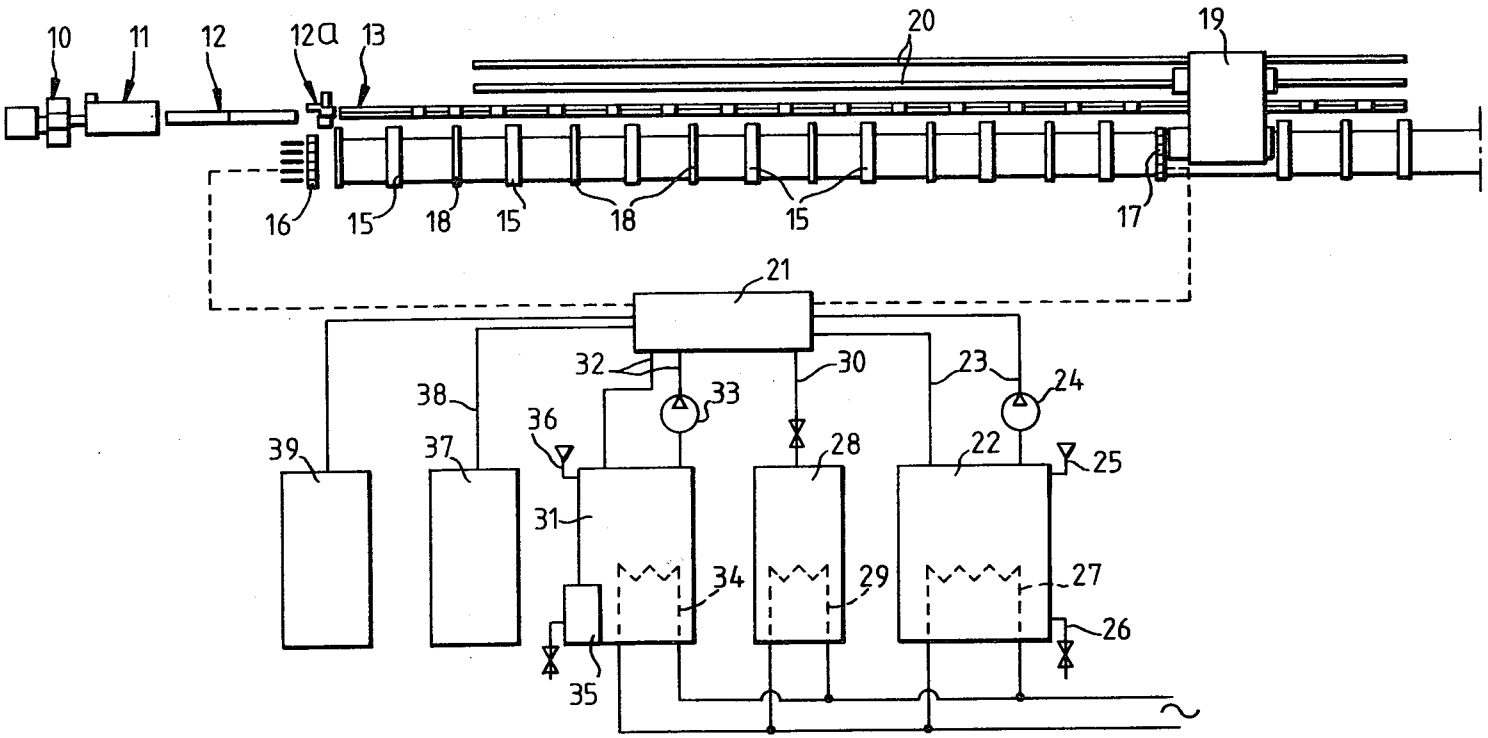

Recently drawn metal tubes are generally cleaned either with a chlorinated hydrocarbon or with an alkali solution. The chlorinated hydrocarbon can be regenerated and does not involve any dumping problems. Alkali solutions, however, must be considered as consumed and, taking into consideration the large quantities involved when it is the question of an industrial installation for drawing of tubes, the handling of the waste from the cleaning process may involve difficulties.

Each one of the two above mentioned cleaning agents is efficient but from a chemical point of view they function in different ways. When extremely high standards are applied regarding cleanness as e.g. when it is the question of tubes to be used in the process industry it may be an advantage to use both cleaning agents.

It is an object of the present invention to provide a cleaning method with which extremely well cleaned inner surfaces of tubes can be obtained with short handling times and with low consumption of cleaning agents, preferably subsequent to an exterior cleaning process.

This object is attained by using the regenerative cleaning agent for a first substantial interior cleaning, which is followed by a cleaning operation consisting of blowing steam through the tubes before the interior of the tubes is exposed to the cleaning action of the alkali solution. The whole sequence of operations should be carried out in steps following each other rapidly and a plant according to the invention is characterized by means of connection for both ends of the tubes, containers for the two different cleaning agents, a vapour source and means to connect respectively the containers and the vapour source with the above mentioned means of connection in order to permit flushing of the interior of the tubes first with one of the cleaning agents and then with the other permitting furthermore that between the above mentioned flushing operations the tubes should be blown clean with steam.

The installation should also include a container for de-ionizated water and a source of clean, compressed air free from oil as well as means to connect these containers with the above mentioned means of connection in sequence after the flushing with the second cleaning agent. The whole process can be completed with a second blowing of steam through the tubes. The installation should preferably be placed directly after the tube drawing installation and it should include an intermediate station for mechanical wiping to remove interior coatings of drawings compound. The installation should also preferably include means to place a number of recently drawn tubes in parallel positions and to connect them to the above mentioned connecting means.

One of the connecting means should preferably be fixed, whilst the connecting means of the other side of the tube should be sited on a movable bench or frame permitting a displacement in the axial direction of the tubes. The bench or frame should preferably be provided with individual connection means for each one of the tubes, which also should be movable in the axial direction of the tubes.

The containers may be provided with means to keep the cleaning agents at an elevated temperature, preferably at about 90° C. One of the containers is intended to contain a chlorinated hydrocarbon. This container is provided with connections permitting the exchange of cleaning agent. The other container is intended for the alkali solution with additives in form of complex formers and wetting agents. This last mentioned container is provided with a connection for drainage of gel.

Figure 2:
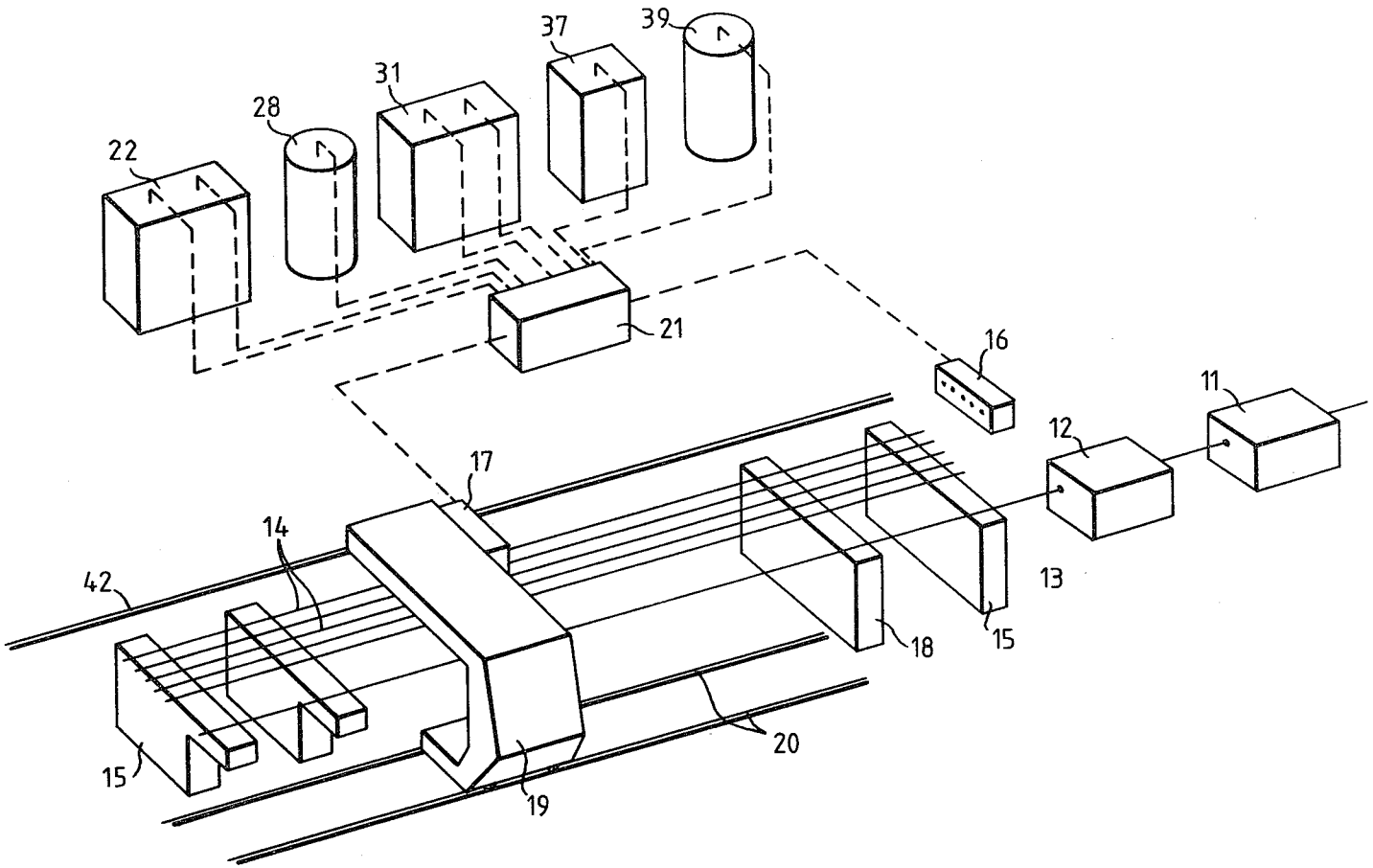
Figure 3:
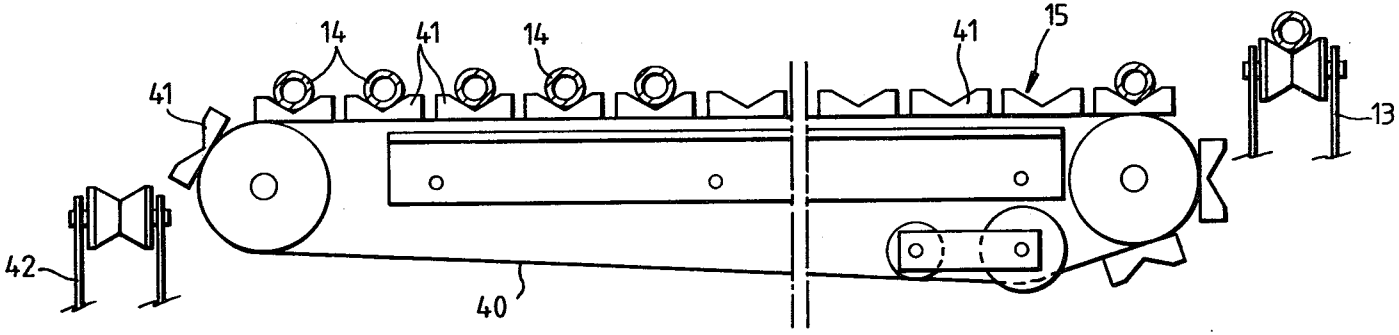
Figure 4:
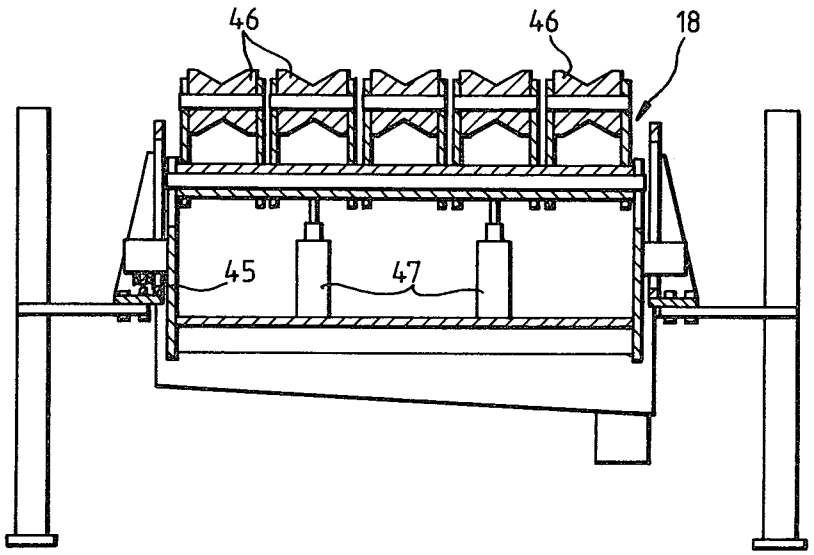
Figure 5:
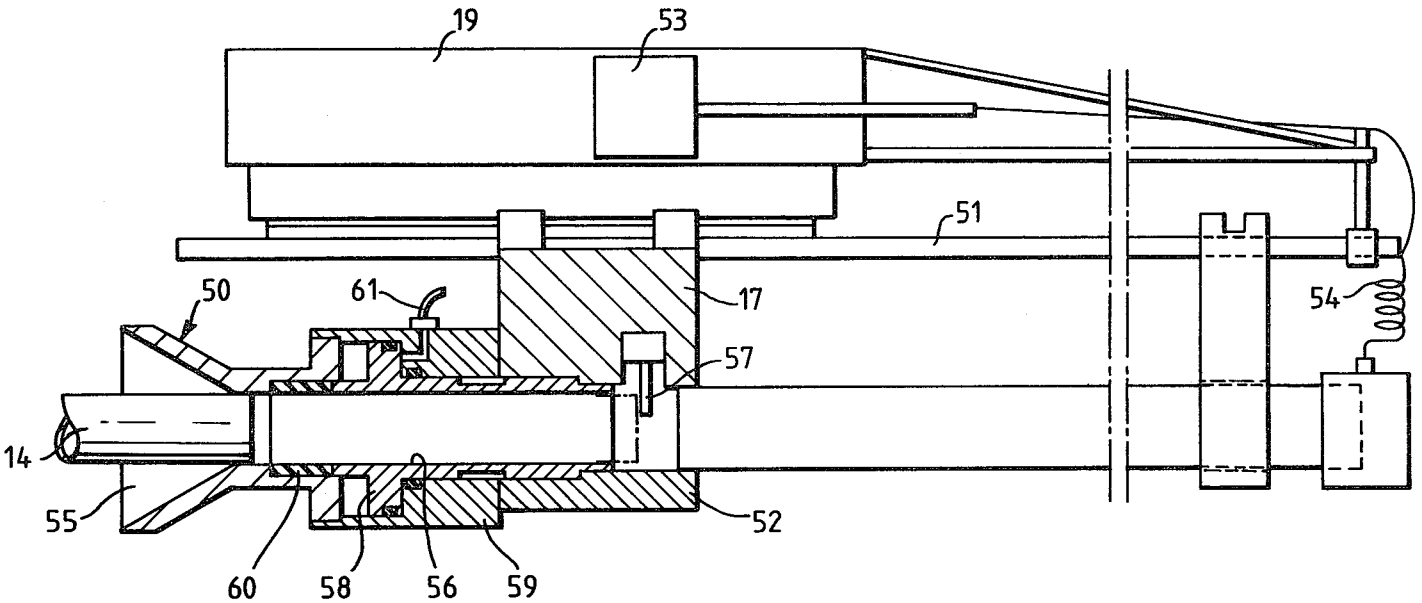

The above invention will become more readily apparent from the following description reference being made to the accompanying drawings, in which FIG. 1 shows schematically a cleaning installation according to the present invention, FIG. 2 shows in perspective part of the installation according to FIG. 1, FIG. 3 shows part of the means for placing a number of tubes in parallel positions, FIG. 4 shows means to lift a number of tubes to a proper position for connection to the connection means, and FIG. 5 shows details of the connection means.

FIG. 1 shows very schematically an installation for cleaning of recently drawn tubes, adjacent to a tube drawing machine (not shown).

The tube drawing machine may be of different types and these machines are well known, thus not requiring any closer explanation. After the tube drawing machine there is a machine 10, in which the ends of the tubes are evened and plugs are introduced in the ends of the tubes in order to avoid that the interior of the tubes is influenced by the following exterior cleaning treatment of the tubes.

At 11 there is an installation for exterior cleaning of the recently drawn tubes, where these tubes are exposed to the action of cleaning agents e.g. some of the agents which are used for the interior cleaning. The exterior cleaning process is completed with brushing and/or other mechanical treatment. At 12 the exterior surface of the tubes is dried.

When the tube blank passes the drawing machine, there may occur an overheating of drawing compound at the drawing punch resulting in resinous coatings and/or burnt-in soot on the interior tube surface. These coatings are very difficult to remove. The tubes are frequently rather long having a rather small inner diameter, thus practically excluding the possibility of using mechanical cleaning means for interior cleaning.

One of the differences between the chlorinated hydrocarbons and the alkali solutions is that the first mentioned agents do have the capability of attacking the carbon constituents of the coatings in such a way that they get porous, thus permitting the alkali solution to penetrate into the coating in connection with the subsequent treatment with alkali solution. When the alkali solution is enabled to penetrate into the spongy coating, it will be able to break down the sponge coating.

It is assumed that the tubes after an exterior cleaning in station 11, 12, are conveyed on a conveyor 13. One first step belonging to the interior cleaning process of the tubes consists in scraping off the drawing compound remaining in the interior of the tube. This can be achieved in such a way that one of the end plugs is pushed through the tube using compressed air in order to exert a pushing force on the plug which is to be moved through the interior of the tube. The drawing compound which has been removed in this way can be recycled for renewed use in the drawing machine, if the drawing agent is cleaned from impurities. The drawing compound is gathered at 12*a*.

In order to facilitate the subsequent handling and in order to reduce handling time a number of tubes 14 are placed together in parallel positions for simultaneous treatment. Apart from the conveyor 13 there are several transverse conveyors 15—See FIG. 3 which take care of the tubes when they leave station 12 taking them laterally to predetermined positions below the connection means 16 and 17, which are arranged in such a way that they can take care of a number of tubes, e.g. five tubes.

Adjacent to the transverse conveyors 15 there are lifting means 18—See FIG. 4—which will take care of the group of (five) tubes lifting them to a proper position for connection with the connection means 16, 17. The lifting means 18 will lower the (five) tubes again when the interior cleaning process has been terminated.

It may be convenient and advantageous to produce tubes with different nominal lengths and thus the connection means 16 will be fixed whilst the connection means 17 will be placed on a movable frame 19, which can move on rails 20 enabling the connection means 17 to move along the conveyor 13 for at least part of its length.

The provision of cleaning fluids is determined by a control device 21, which can be programmed in different ways in order to permit different duration of action of the different fluids. The process has, however, a predetermined order of sequence in which the different fluids should be applied. The control device 21 can be arranged in such a way that it controls the positioning of the tubes and the connection of the tubes to the connection devices 16, 17, but it is, of course, also possible to have a separate control device for the mechanical part of the operation, which gives a signal to the control device 21 when the tubes are connected and ready for cleaning.

In a first container 22 there is a chlorinated hydrocarbon, e.g. perchloroethylen, which can be flushed through the tubes passing the tubing 23 and the pump 24 and furthermore the control device 21. This container 22 is provided with connections 25, 26, which permit the exchange of cleaning agent which should be replaced after some time of use. The fluid which has been drained can, as mentioned before, be regenerated and thus recirculated and reused. The treatment should preferably be carried out with the fluid at an elevated temperature of e.g. 90° C., and the container is thus provided with heating means in the form of a heating coil 27.

The steam source, e.g. a boiler 28, which may be heated by means of a heating coil 29, is connected to the control device 21 by means of a pipeline 30. The flushing with chlorinated hydrocarbon is carried out during a predetermined period of time and thereafter steam is blown through the tubes in order to remove any remaining particles of hydrocarbon before the following treatment with alkali solution is initiated.

The alkali solution is kept in a second container 31, which is connected to the control device 21 by means of a conduit 32 and a pump 33. The container 31 is also provided with a heating coil 34. The alkali solution contains wetting agents and complex formers, e.g. natrium gluconic composites, which together with the remaining impurities from the inner surfaces of the tubes will form a gel-similar substance, which can be separated from the alkali solution. This is illustrated schematically on the drawing showing separation means 35 and showing furthermore connection 36, which is used for refilling alkali solution corresponding to the quantities consumed.

A further container 37 contains de-ionized water and is connected to the control device 21 by means of a conduct 38. The de-ionized water is flushed through the tubes after the treatment with alkali solution thus neutralizing the surfaces.

There is furthermore a source of compressed air 39. Following the flushing with de-ionized water the tubes may be blown clean with steam and thereafter they can be dried clean using compressed air free from oil. The tubes are finally loosened from the connection devices 16, 17 and thereafter the ends of the tubes are sealed with plugs. The treatment is thereby terminated and the tubes can be conveyed to a stock or to other machines for further processing.

In the figure the containers and the sources for steam and compressed air are, in order to facilitate comprehension, connected directly to the control device 21, which in its turn is connected to the connection means 16, 17. In order to obtain an efficient separation between the different fluids it may, however, be of advantage to connect each container or source directly with connection means 16, 17 and let the control device control valves and/or pumps in the different connecting pipes.

FIG. 2 shows schematically and in a somewhat larger scale and in perspective part of FIG. 1. After having passed the operations corresponding to 11 and 12 the recently drawn tubes are conducted along the conveyor 13 to positions between the connection means 16 and 17, where the transverse conveyors 15 take over gathering a suitable number of tubes, e.g. five. These groups of tubes are lifted up to the level of the connection means 16 and 17, to which they are connected. The cleaning fluids are conducted to pass the tubes. The handling of tubes required to achieve the above described operations can be arranged and can be controlled in different ways which are obvious to the professional acquainted with the art.

One of the transverse conveyors 15 is shown on FIG. 3 and a number of transverse conveyors 15 are installed to work synchronized with conveyor 13 in order to remove the tubes from the last mentioned conveyor. There are means (not shown on the drawings) which transfer the tubes from conveyor 13 to the transverse conveyors 15. Each one of the transverse conveyors 15 includes an endless band 40 moving around two drums. The band part is provided with a number of supporting devices 41 designated each one to carry a tube 14. The length of the transverse conveyors 15 and the number of supporting means 41 on each conveyor is such that the conveyor can stock a number of tubes whilst the previous set of e.g. five tubes is being cleaned. After cleaning, the tubes are transferred to a conveyor 42, which conveys the cleaned tubes for further handling.

The transverse conveyors 15 can be driven in any suitable way and they are controlled in such a way that the supporting means are moved forwards step by step advancing one step for each tube arriving from conveyor 13.

The conveyor 13 as well as the conveyor 42 have been shown placed beside the transverse conveyors 15 in order to facilitate comprehension of the drawing. Both conveyors can, however, be placed in such a way that their centre line will be placed above the first and the last of the supporting means 41 belonging to the transverse conveyors 15 and at an elevated level in relation to the transverse conveyors 15. The tubes would thus be lowered down vertically on to the transverse conveyors 15 and lifted up vertically when being transferred to the removing conveyor 42.

Another solution is to convey the whole group of tubes from the transverse conveyors using an overhead crane to remove the tubes from the cleaning station when they are cleaned.

A lifting device 18, with which the five tubes can be lifted up to a position suitable for connection with the connection means 16, 17 is shown on FIG. 4. A frame 45 supports five double conical rollers 46. The distance between the consecutive rollers 46 is equal to the corresponding distance between the supporting devices 41 on the transverse conveyors 15. The rollers can be moved vertically by means of fluid jacks 47 working under pressure. The movements of the conveyors 15 and the devices 18 may be controlled by special control devices as mentioned above. These control devices could also control the connection operations to the connection devices 16, 17.

Drawn tubes have certain length tolerances. When it comes to tubes which are e.g. 40 meter long these tolerances maybe ±1 meter. The corresponding variations in length imply certain difficulties when a number of tubes should be connected in parallel positions. The first connection device 16 has, as mentioned before, a fixed position. The transition of the tubes from the conveyor 13 to the transverse conveyors 15 is carried out in such a way that the ends of the tubes 14 are placed in determined positions in relation to the connection device 16.

The frame 19 is movable in the direction of the length of the installation in order to make it possible to take consideration to the different nominal lengths of the tubes. The connection means 17 are provided with connecting means 50 which are individually adjustable in the direction of the length of the installation. Connection means 50 are shown in FIG. 5.

An upper beam 19 carries rails 51, which in their turn support carriages 52. The carriages 52 carry the coupling devices. The frame has a distribution box 53, which is connected to the connection means by means of tubes 54.

The connection means consist of a guiding funnel 55 and a tube-formed part 56 suitable to receive the end of the tube 14. In order to achieve a fully acceptable grip the tube should be introduced far enough to act on a sensor 57.

The tube-formed part 56 supports a piston 58, which works inside a cylinder 59. Between the end of the tubular part 56 and the guiding funnel 55 there is a packing 60, which has the form of a ring.

When a tube activates the sensor 57 compressed air is supplied through pipe 61 to the cylinder 59 and thus the piston 58 is displaced to the left as shown on the drawing. The packing 60 is thus compressed and tightens around the tube. When all tubes are connected in this way a signal is given which starts the supply of cleaning agents.

This connection 10 is provided with a connection device 50 equal to the device described above, each comprising a quiding funnel 55, a sensor 57 and a piston 58 as well as a compressible packing 60. The connection device 10 is, however, fixed as mentioned previously.

The displacement of the carriages 52—which can be of different lengths depending on the tolerances of the tubes—is thus required to permit the connection of both ends of the tubes.

The embodiment described above and shown on the drawings is just one example of one form the invention may take. The details can vary in many ways within the scope of the following claims. In FIG. 1 it is assumed that the fluids will flow in one direction, e.g. from right to left but there is, of course, no impediment which would interfere with the possibility to reverse the flow direction at least during some part of the operation.

We claim:

1. An installation for internal cleaning of tubes, said tubes having a front end and a rear end, the installation comprising a first means for connecting a first fluid conduit to one end of said tubes; a second means for connecting a second fluid conduit to the other end of said tubes; containers for two different fluid cleaning agents; a steam source; and means for connecting respectively said containers and said steam source with said fluid conduits for causing fluid flow through said conduits according to a pre-determined sequence in order to first flush through the tubes one of the fluid cleaning agents, then subjecting the tubes to a period of clean blowing with steam, and then to flush through the tubes the other fluid cleaning agent.

2. An installation according to claim 1, further comprising a container for de-ionized water and means for connecting said de-ionized water container with said fluid conduits for causing de-ionized water to flush said tubes following flushing with said second fluid cleaning agent.

3. An installation according to claim 2, further comprising a dry, compressed air source and means for connecting said compressed air source with said fluid conduits for causing air flow through said conduit whereby following flushing with de-ionized water, the tubes are subjected to a period of clean blowing with dry, compressed air.

4. An installation according to claim 1 or 10, wherein said installation is placed adjacent to a tube drawing installation and further comprises means for mechanically scraping the interiors of said tubes.

5. An installation according to claim 4, which further comprises means for gathering a number of recently drawn tubes in parallel positions and simultaneously connecting them to said fluid conduits.

6. An installation according to claim 5, wherein one of said means for connecting a fluid conduit to one end of said tubes is fixed and the other is mounted on a frame, which is movable in the axial direction of the tubes.

7. An installation according to claim 6, wherein said frame is provided with individual connection means for connecting each of said tubes with said fluid conduit, and said individual connection means are movable axially of each tube.

8. An installation according to claim 1, wherein said containers for two different fluid cleaning agents are each provided with means to keep the fluids at an elevated temperature.

9. An installation according to claim 1, wherein one of said containers for a fluid cleaning agent contains a chlorinated hydrocarbon and is provided with an inlet for adding fluid to said container and an outlet for removing fluid from said container; and the other container contains an alkali solution of wetting agents and complex formers and is provided with a connection for removal of gel-like deposits which form within the container.

* * * * *